US007566053B2

(12) United States Patent
Mandel et al.

(10) Patent No.: US 7,566,053 B2
(45) Date of Patent: Jul. 28, 2009

(54) MEDIA TRANSPORT SYSTEM

(75) Inventors: Barry Paul Mandel, Fairport, NY (US); Michael F. Leo, Penfield, NY (US); Injae Choi, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 11/109,566

(22) Filed: Apr. 19, 2005

(65) Prior Publication Data

US 2006/0237899 A1 Oct. 26, 2006

(51) Int. Cl.
*B65H 29/00* (2006.01)

(52) U.S. Cl. ..... 271/186; 271/291

(58) Field of Classification Search ..... 271/291, 271/186, 301, 185
See application file for complete search history.

(56) References Cited

U.S. PATENT DOCUMENTS

| | | | | |
|---|---|---|---|---|
| 4,579,466 | A | | 4/1986 | Sato |
| 4,587,532 | A | | 5/1986 | Asano |
| 4,836,119 | A | | 6/1989 | Siraco |
| 5,004,222 | A | | 4/1991 | Dobashi |
| 5,026,037 | A | * | 6/1991 | Masuda ..... 271/3.03 |
| 5,080,340 | A | | 1/1992 | Hacknauer |
| 5,095,342 | A | | 3/1992 | Farrell |
| 5,159,395 | A | * | 10/1992 | Farrell et al. ..... 399/401 |
| 5,208,640 | A | | 5/1993 | Horie |
| 5,272,511 | A | | 12/1993 | Conrad |
| 5,326,093 | A | | 7/1994 | Sollitt |
| 5,389,969 | A | | 2/1995 | Suzuki |
| 5,435,544 | A | | 7/1995 | Mandel |
| 5,473,419 | A | | 12/1995 | Russel |
| 5,504,568 | A | | 4/1996 | Saraswat |
| 5,525,031 | A | | 6/1996 | Fox |
| 5,557,367 | A | | 9/1996 | Yang |
| 5,568,246 | A | | 10/1996 | Keller |
| 5,570,172 | A | | 10/1996 | Acquaviva |
| 5,596,416 | A | | 1/1997 | Barry |
| 5,629,762 | A | | 5/1997 | Mahoney |
| 5,710,968 | A | | 1/1998 | Clark |
| 5,778,377 | A | | 7/1998 | Marlin |
| 5,884,910 | A | | 3/1999 | Mandel |
| 5,995,721 | A | | 11/1999 | Rourke |
| 6,059,284 | A | | 5/2000 | Wolf |
| 6,125,248 | A | | 9/2000 | Moser |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Patrick H Mackey
*Assistant Examiner*—Howard Sanders
(74) *Attorney, Agent, or Firm*—Fay Sharpe LLP

(57) ABSTRACT

A printing system is provided comprising a marking engine and an inverter. The inverter includes an entrance path having a first reversing inverter drive nip system and a second reversing drive nip system. The printing system further includes a marking path and a duplex path whereby a plurality of media sheets move through the entrance path, the marking path and the duplex path in a first order sequence. The plurality of media sheets return to the entrance path wherein the plurality of media sheets are inverted and moved again through the marking path in a second order sequence.

17 Claims, 10 Drawing Sheets

U.S. PATENT DOCUMENTS

| | | | | |
|---|---|---|---|---|
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III | |
| 6,409,400 | B1 * | 6/2002 | Arai | 396/612 |
| 6,450,711 | B1 | 9/2002 | Conrow | |
| 6,476,376 | B1 | 11/2002 | Biegelsen | |
| 6,476,923 | B1 | 11/2002 | Cornell | |
| 6,493,098 | B1 | 12/2002 | Cornell | |
| 6,537,910 | B1 | 3/2003 | Burke | |
| 6,550,762 | B2 | 4/2003 | Stoll | |
| 6,554,276 | B2 | 4/2003 | Jackson | |
| 6,577,925 | B1 | 6/2003 | Fromherz | |
| 6,607,320 | B2 | 8/2003 | Bobrow | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon | |
| 6,633,382 | B2 | 10/2003 | Hubble, III | |
| 6,639,669 | B2 | 10/2003 | Hubble, III | |
| 6,819,906 | B1 | 11/2004 | Herrmann | |
| 2002/0078012 | A1 | 6/2002 | Ryan | |
| 2002/0096822 | A1 * | 7/2002 | Glemser et al. | 271/186 |
| 2002/0103559 | A1 | 8/2002 | Gartstein | |
| 2003/0077095 | A1 | 4/2003 | Conrow | |
| 2003/0190179 | A1 * | 10/2003 | Kinoshita et al. | 399/401 |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz | |
| 2004/0150158 | A1 | 8/2004 | Biegelsen | |
| 2004/0153983 | A1 | 8/2004 | McMillan | |
| 2004/0216002 | A1 | 10/2004 | Fromherz | |
| 2004/0225391 | A1 | 11/2004 | Fromherz | |
| 2004/0225394 | A1 | 11/2004 | Fromherz | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.

* cited by examiner

MEDIA TRANSPORT SYSTEM

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. Patent application Ser. No. 10/924,459, filed Aug. 23, 2004, entitled "PARALLEL PRINTING ARCHITECTURE USING IMAGE MARKING DEVICE MODULES," by Barry P. Mandel, et al;

U.S. patent application Ser. No. 10/933,556, filed Sep. 3, 2004, entitled "SUBSTRATE INVERTER SYSTEMS AND METHODS," by Stan A. Spencer, et al.;

U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. Patent application Ser. No. 10/999,450, filed Nov. 30, 2004, entitled "ADDRESSABLE FUSING FOR AN INTEGRATED PRINTING SYSTEM," by Robert M. Lofthus, et al.;

U.S. patent application Ser. No. 11/000,158, filed Nov. 30, 2004, entitled "GLOSSING SYSTEM FOR USE IN A TIPP ARCHITECTURE," by Bryan J. Roof;

U.S. patent application Ser. No. 11/000,168, filed Nov. 30, 2004, entitled "ADDRESSABLE FUSING AND HEATING METHODS AND APPARATUS," by David K. Biegelsen, et al.;

U.S. patent application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore;

BACKGROUND

The present exemplary embodiments relate to media (e.g., document or paper) handling systems and systems for printing thereon and are especially applicable for a printing system comprising a plurality of associated marking engines.

Printing systems including a plurality of marking engines are known and have been generally referred to as tandem engine printers or cluster printing systems. See U.S. Pat. No. 5,568,246. Such systems especially facilitate expeditious duplex printing (both sides of a document are printed) with the first side of a document being printed by one of the marking engines and the other side of the document being printed by the same or another marking engine so that parallel printing of sequential documents can occur. The process path for the document usually requires an inversion of the document (the leading edge is reversed to become the trailing edge) to facilitate printing on the back side of the document. Inverter systems are well known and essentially comprise an arrangement of nip wheels or rollers which receive the document by extracting it from a main process path, then direct it back on to the process path after a 180° flip so that what had been the trailing edge of the document now leaves the inverter as the leading edge along the main process path. Inverters are thus fairly simple in their functional result; however, complexities occur as the printing system is required to handle different sizes and types of documents and where the marking engines themselves are arranged in a parallel printing system to effect different types of printing, e.g., black only printing versus color or custom color printing.

As a document is transported along its process path through the system, the document's precise position must be known and controlled. The adjustment of the documents to desired positions for accurate printing is generally referred to as a registering process and the apparatus used to achieve the process are known as registration systems. See U.S. Pat. No. 4,941,304, which is incorporated herein by reference. Precision registration systems generally comprise nip wheels in combination with document position sensors whereby the position information is used for feedback control of the nip wheels to adjust the document to the desired position. It can be appreciated that many registration systems require some release mechanism from the media handling path upstream of the nip registration wheels so that the wheels can freely effect whatever adjustment is desired. This requires a relatively long and expensive upstream paper handling path. In parallel printing systems using multiple marking engines, the required registration systems also adds to the overall media path length. As the number of marking engines increases, there is a corresponding increase in the associated inverting and registering systems. As these systems may be disposed along the main process path, the machine size and paper path reliability are inversely affected by the increased length of the paper path required to effectively release the documents for registration. Lateral paper registration requirements for containerized marking engines are challenging due to the need to accommodate both edge-registered and center-registered marking engines.

Another disadvantageous complexity especially occurring in parallel printing systems is the required change in the velocity of the media/document and/or desired sequencing, as it is transported through the printing system. As the document is transported through feeding, marking, and finishing components of a parallel printing system, the process speed along the media path can vary to a relatively high speed for transport along a highway path, but must necessarily be slowed for some operations, such as entering the transfer/marking system apparatus. Effective apparatus for buffering such required velocity changes and/or re-sequencing of the media also requires an increase in the main process path to accommodate document acceleration, deceleration, and sequencing between the different sections of the process path.

Especially for parallel printing systems, architectural innovations which effectively shorten the media process path, enhance the process path reliability and reduce overall machine size are highly desired. Additionally, it is desirable to have inverters that can act upon more than one media sheet at the same time and do more than simply invert, for example, stage, buffer, re-sequence, and/or return media to a process path (inverted or uninverted).

BRIEF SUMMARY

The proposed development comprises an inverter for accomplishing necessary document handling functions above and beyond the mere document inversion function. The combined functions also include staging and resequencing of the documents within the inverter assembly. The document handling functions further include processing and inverting more than one sheet of media at the same time for yielding a more compact and cost effective media path.

A xerographic or sheet printing device (i.e. solid ink printer) is provided comprising a marking engine and an inverter. The inverter includes an entrance path having a first reversing inverter drive nip system and a second reversing drive nip system. The device further includes a marking path and a duplex path whereby pairs of media sheets move through the entrance path, the marking path and the duplex path in a first order sequence. The pairs of media sheets return to the entrance path wherein the pairs of media sheets are inverted and moved again through the marking path in a second order sequence.

A printing system is provided including an inverter assembly associated with a marking engine. The inverter assembly includes a first reversing inverter drive nip system and a second reversing inverter drive nip system spaced therefrom wherein a plurality of media sheets enter said inverter assembly in a first order sequence and exit said inverter assembly inverted in a second order sequence.

An inverter apparatus is provided in association with a marking engine for selectively inverting at least two documents for tandem transport along a media path. The apparatus comprises an inverter having selectively reversing inverter rollers, an input path, a staging path, and an output path. The at least two documents move in first direction through the input path into the staging path in a first order and then move in a second direction through the output path in a second order.

A method of processing documents for transport through a printing system is provided for enhancing document control and reducing transport path distance. The printing system includes an inverter assembly comprising nip drive rollers for grasping the document and a marking engine. The method includes transporting at least two documents to the inverter assembly. The at least two documents are then transported from the inverter assembly in a first egress order through a marking engine for marking on each of a first side. The documents are returned along a duplex path to the inverter assembly. After returning, the at least two documents can be transported from the inverter assembly in a second egress order through the marking engine for marking on each of a second side.

A method of processing documents for transport through a printing system is provided for enhancing document control and reducing transport path distance. The method includes transporting at least two documents to the inverter assembly through an input path in a first order. The inverter assembly includes a first reversing drive nip system and a second reversing drive nip system for grasping a plurality of documents. The at least two documents can be transported from the inverter assembly through an output path in a second order.

The embodiments described herein can effectively combine the functions of inverting, velocity buffering, staging, and sequencing for at least two media sheets simultaneously in the same inverter assembly for even more enhanced efficiency and size reductions in the paper handling path and overall machine size.

DETAILED DESCRIPTION OF THE EXEMPLARY EMBODIMENTS

Figure 1:
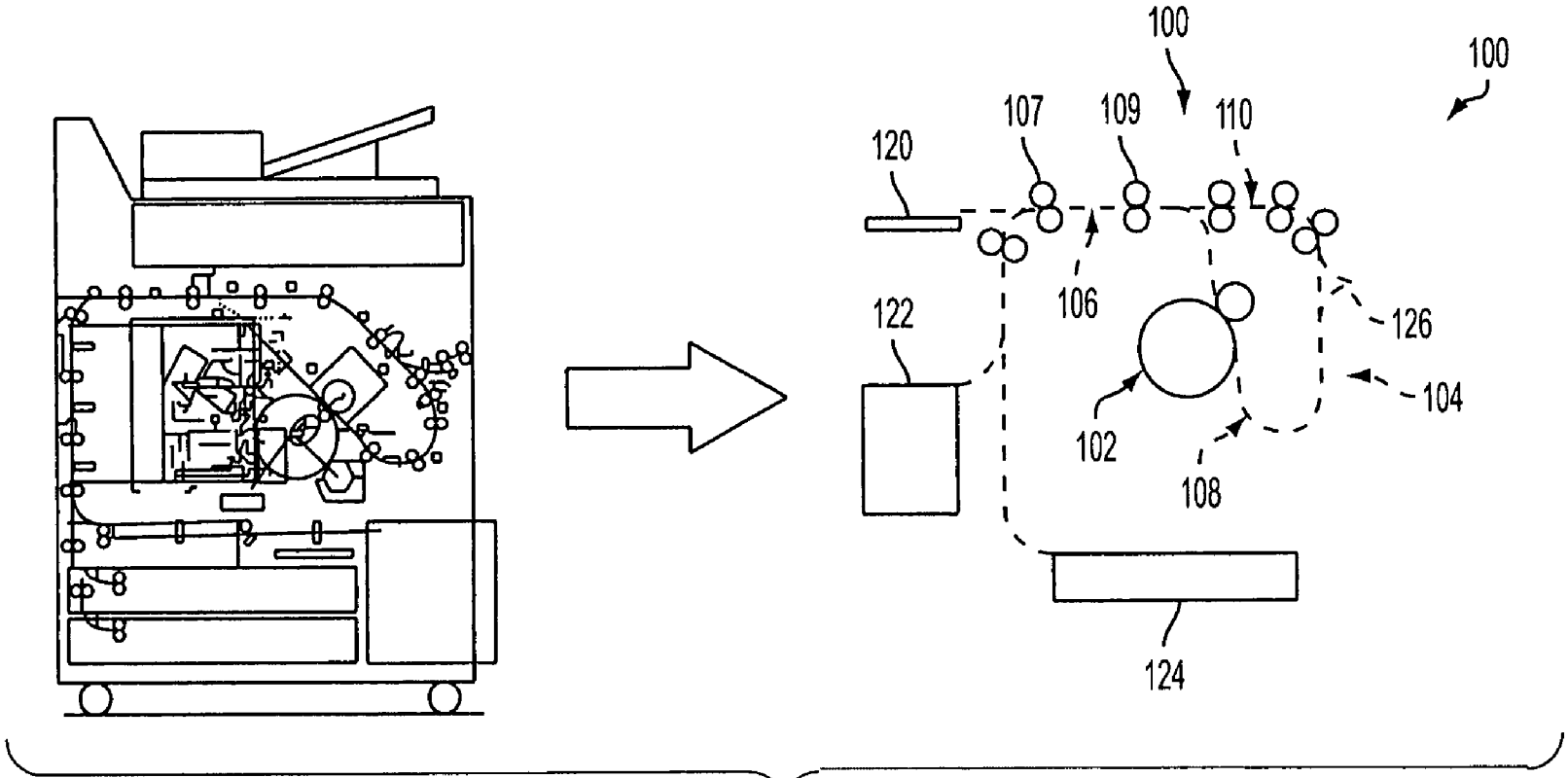
FIG. 1 shows a schematic view of a printing system illustrating selective architectural components according to a first embodiment of the subject developments.
Figure 4:
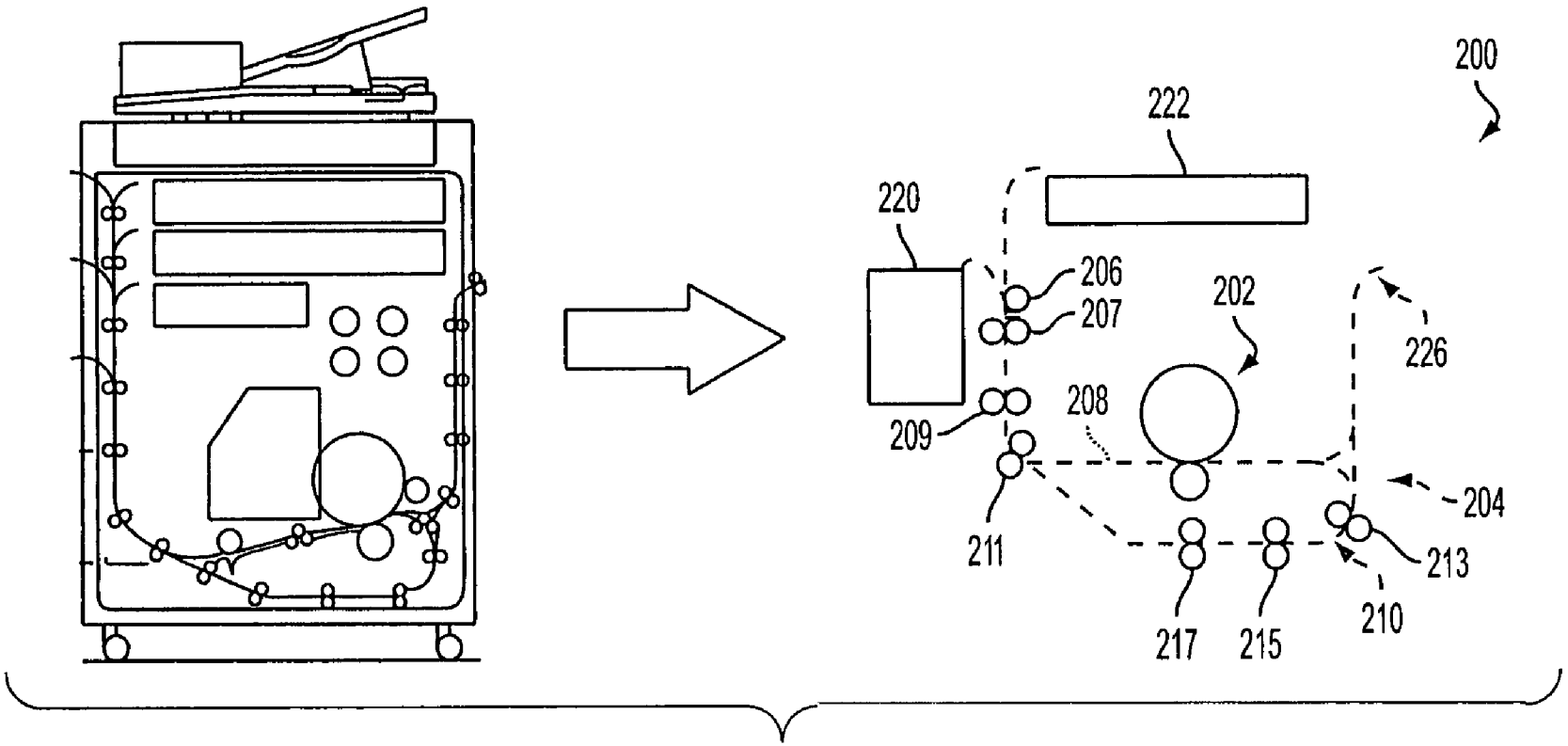
FIG. 4 shows a schematic view of a printing system illustrating selective architectural components according to a second embodiment of the subject developments.
Figure 7:
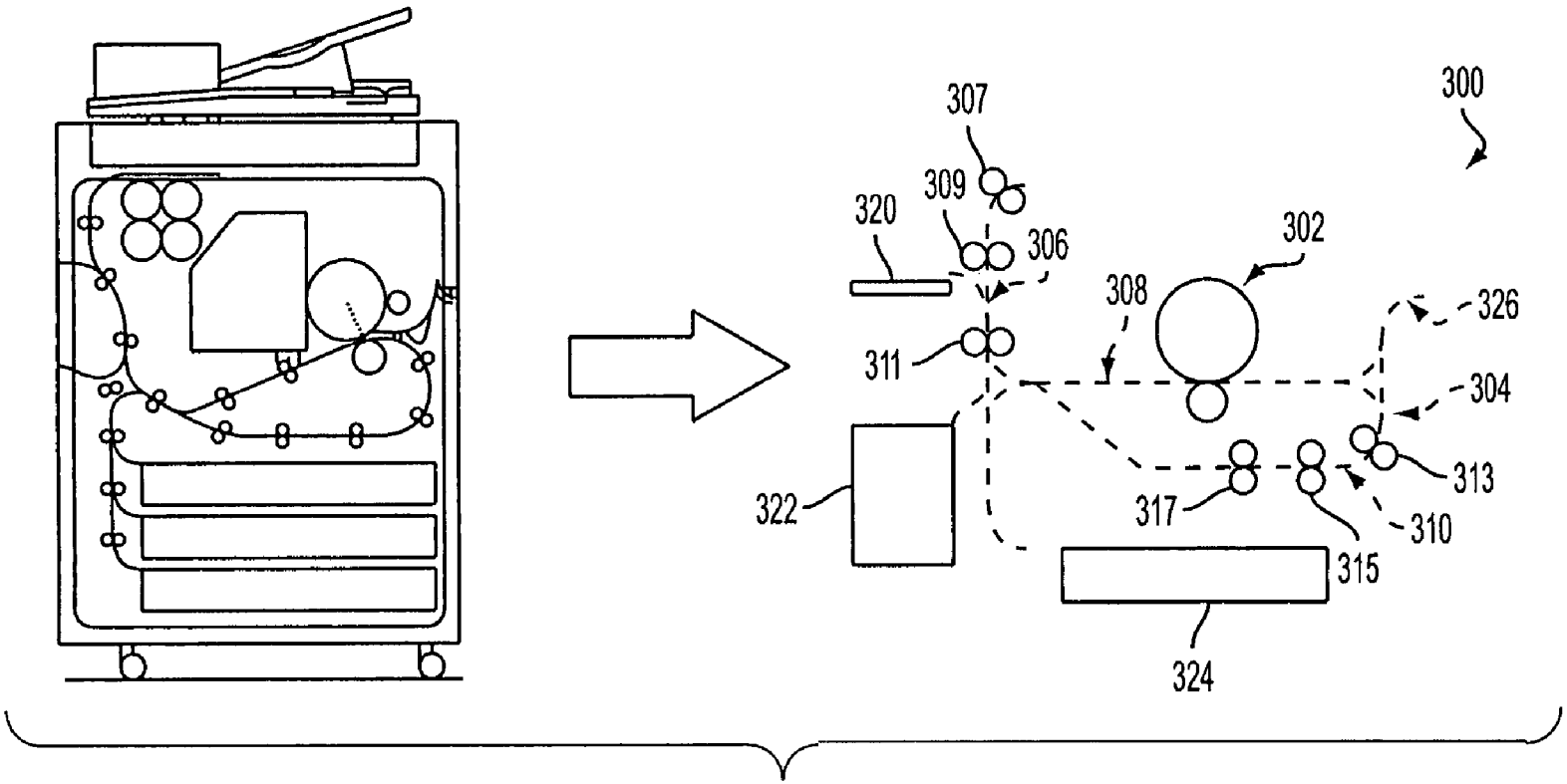
FIG. 7 shows a schematic view of a printing system illustrating selective architectural components according to a third embodiment of the subject developments.

With reference to the drawings wherein the showings are for purposes of illustrating alternative embodiments and are not for limiting same. FIGS. 1, 4, and 7 show schematic views of printing systems comprising marking engines that can be associated with integrated parallel printing of documents within an integrated printing system (to be described in more detail below). More particularly, a printing system is illustrated as including primary elements comprising a marking engine or Image Output Terminal (IOT) and a reversing roll or inverter media transport system. The transport system further includes an entrance path, a marking path, and a duplex path for moving media sheets or documents through the printing system. The media transport system is capable of delivering and receiving singles, pairs or combinations of simplex and duplex sheets to and from a transfer station. The inverter media transport system can invert more than one sheet of media at the same time. The reversing or inverter media path includes more than one reversing drive nip system.

To be described in more detail below, the media transport systems also include the capability to invert sheets using a section of media path that is also used to transport media in a non-inverting mode. The printing systems enable the inverter media transport system to stage and print on at least two sheets at once or in close succession in "burst mode". Burst mode occurs when at least two sheets of, for example, letter size media are fed at high velocity and in rapid succession into a drum transfix nip to transfer the image from the drum onto the media. The gap between the media sheets within a group or tandem can be about 7 mm. It is to be appreciated that the gap between sheets in one tandem can be smaller than a gap between the one tandem and another tandem. Delivering sheets in rapid succession, in both simplex and duplex modes, presents quite a challenge. Several different media path architectures are shown in FIGS. 1, 4, and 7. The different architectures each make use of multiple nip inversion systems, as will be described in more detail below.

Figure 2:
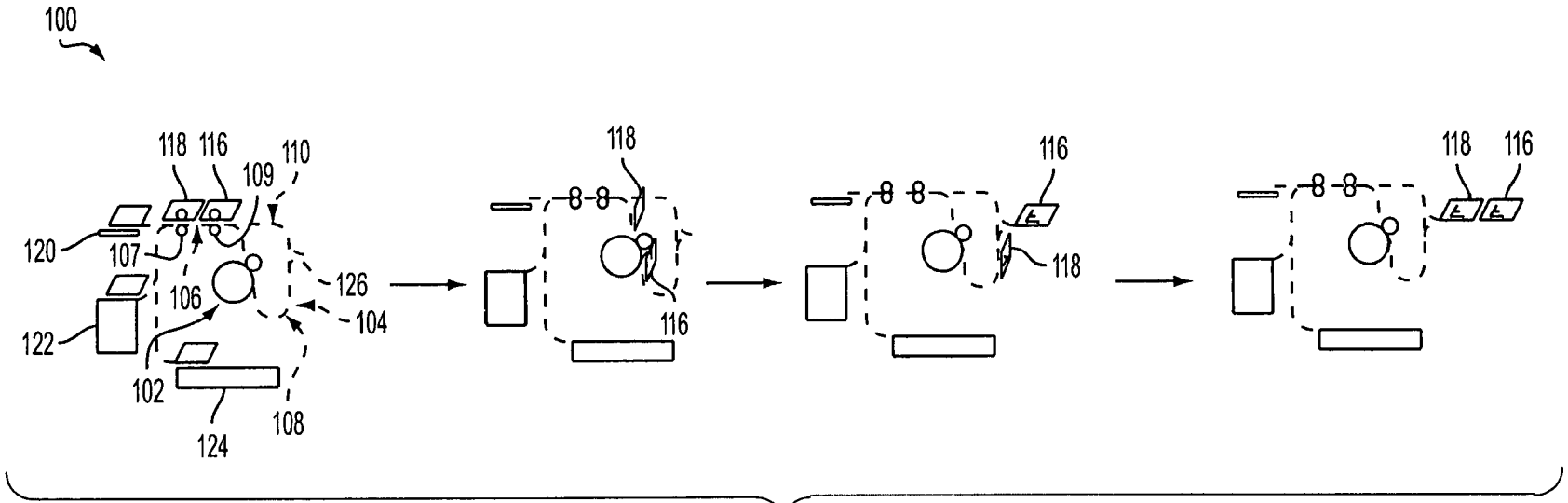
FIG. 2 is a series of sequential schematic views illustrating a simplex flow of media sheets through the printing system according to the first embodiment.
Figure 3:
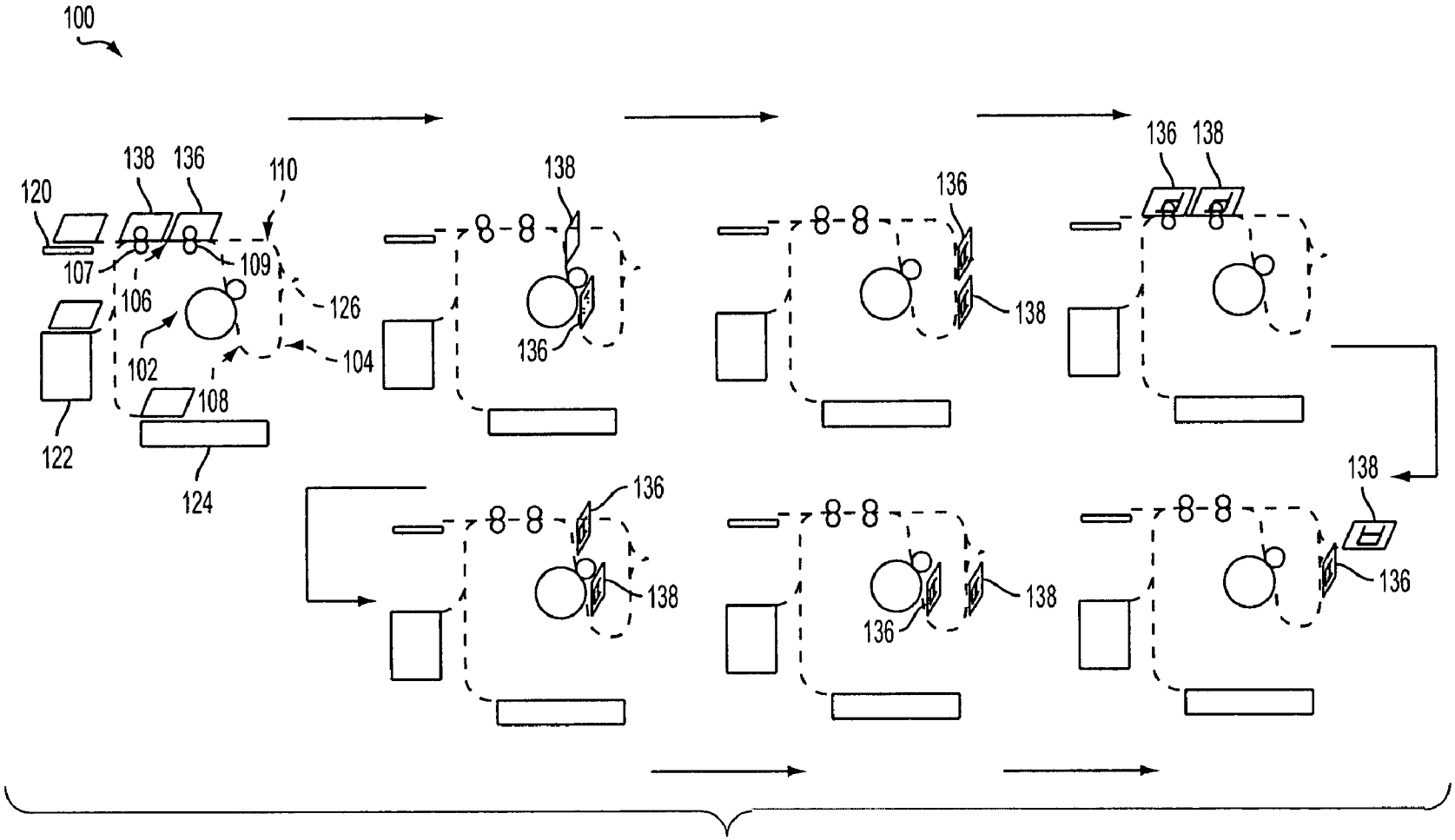
FIG. 3 is a series of sequential schematic views illustrating a duplex flow of media sheets through the printing system according to the first embodiment.

Referring now to FIGS. 1-3, a schematic view is therein shown of a sheet printing system (i.e. solid ink printer) or xerographic device 100 comprising a marking engine according to a first embodiment. More particularly, printing system 100 is illustrated as including primary elements comprising a marking engine or IOT 102 and a reversing roll or inverter media transport system 104. The transport system 104 further includes an entrance path 106, a marking path 108, and a duplex path 110 for moving media sheets or documents through the printing system 100. The entrance path 106 can include more than one reversing drive nip system. As shown in FIG. 1, the entrance path can include two reversing drive nip systems 107, 109.

Referring now to FIG. 2, the printing system 100 can move selective media sheets 116, 118 from feeder sources 120, 122, 124 onto the entrance path 106, through the IOT 102 on marking path 108, and outward on an exit path 126. In this manner, media sheets can move in tandem through the printing system 100 in a simplex mode. Although FIG. 2 shows a pair of media sheets in tandem, it is to be appreciated that the tandem can comprise more than two media sheets.

Referring now to FIG. 3, selective other media sheets 136, 138 can move from feeder sources 120, 122, 124 onto the entrance path 106 driven by a forward rotation of drive nip systems 107, 109. The media sheets 136, 138 are then transported through the IOT 102 along marking path 108, around the duplex path 110, and back onto the entrance path 106. The return of sheets 136, 138 to the entrance path 106 can be accomplished by a reverse rotation of drive nip systems 107, 109. Once sheets 136, 138 have been moved back to entrance path 106, the media sheets can be staged. The drive nip systems 107, 109 can once again be driven in a forward direction to move the sheets in a re-sequenced order. It is to be appreciated that the media sheets will now be inverted and re-sequenced as the sheets pass through the IOT 102 the second time. Specifically, during the first pass sheet 136 is the leading or first sheet and sheet 138 is the trailing or second sheet. On the first pass of IOT 102, sheets 136, 138 are marked on first sides. After transport of the sheets back to entrance path 106, the sheets are re-sequenced and the leading sheet now is sheet 138 and the trailing sheet is 136. Subsequent transport through IOT 102 on the next pass marks sheets 138, 136 on a second side. The sheets 138, 136 can now exit the system 100 along exit path 126. In this manner, media sheets can move in the tandem through the printing system 100 in a duplex mode wherein the first sheet processed, i.e. 136 is the last sheet to exit. This transport sequence/configuration can be described as first in/last out (FILO) or last in/first out (LIFO). In the duplex mode as shown in FIG. 3, the transport system 104 includes the capability of inverting and staging sheets by using a section of the transport system 104, i.e. the entrance path 106, which is also used to transport media sheets in an uninverted mode.

Figure 5:
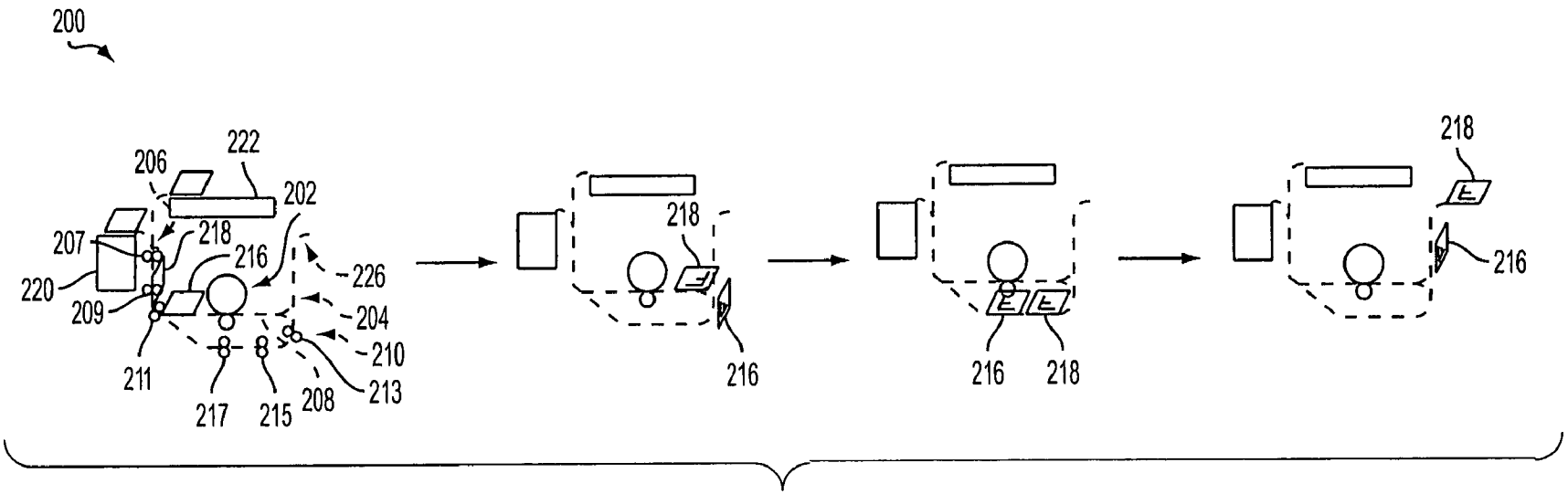
FIG. 5 is a series of sequential schematic views illustrating a simplex flow of media sheets through the printing system according to the second embodiment.
Figure 6:
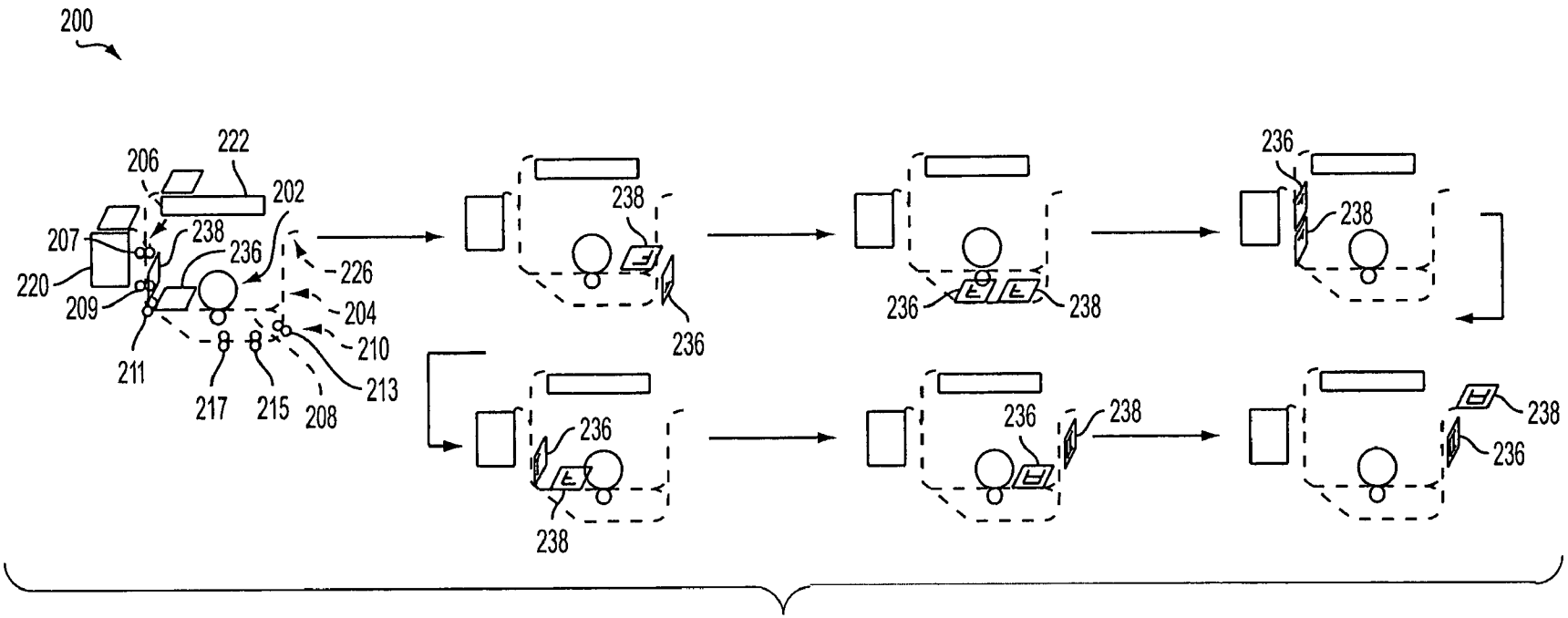
FIG. 6 is a series of sequential schematic views illustrating a duplex flow of media sheets through the printing system according to the second embodiment.

Referring now to FIGS. 4-6, a schematic view is therein shown of a printing system or xerographic device 200 comprising a marking engine according to a second embodiment. More particularly, printing system 200 is illustrated as including primary elements comprising a marking engine or IOT 202 and a reversing roll or inverter media transport system 204. The transport system 204 further includes an entrance path 206, a marking path 208, and a duplex path 210 for moving media sheets or documents through the printing system 200. The entrance path 206 can include more than one reversing drive nip system. As shown in FIG. 4 the entrance path includes three reversing drive nip systems 207, 209, 211.

Referring now to FIG. 5, the printing system 200 can move selective media sheets 216, 218 from feeder sources 220, 222 onto the entrance path 206, through the IOT 202 on marking path 208. It is to be appreciated that the IOT 202 is a face down marking process. The sheets 216, 218 can be inverted before being delivered to an 'up-hill' exit path 226 by driving the pairs of sheets into the duplex path 210 and then reversing their direction. The driving and reversing in the duplex path 210 can be accomplished with multiple reversing drive nip systems 213, 215, 217. In this manner, media sheets can move in tandem through the printing system 200 in a simplex mode wherein the first sheet processed, i.e. 216, can be the last sheet to exit. This transport sequence/configuration can be described relative to the duplex path 210 as first in/last out (FILO) or last in/first out (LIFO).

Referring now to FIG. 6, selective other media sheets 236, 238 can move from feeder sources 220, 222 onto the entrance path 206 driven by a forward rotation of drive nip systems 207, 209, 211. The media sheets 236, 238 are then transported through the IOT 202 along marking path 208, around the duplex path 210, and back onto the entrance path 206. The return of sheets 236, 238 to the entrance path 206 can be accomplished by a reverse rotation of drive nip systems 207, 209, 211. Once sheets 236, 238 have been moved back to entrance path 206, the media sheets can be staged. The drive nip systems 207, 209, 211 can once again be driven in a forward direction to move the sheets in a re-sequenced order. It is to be appreciated that the media sheets will now be inverted and re-sequenced as the sheets pass through the IOT 202 the second time. Specifically, during the first pass sheet 236 is the leading or first sheet and sheet 238 is the trailing or second sheet. On the first pass of IOT 202, sheets 236, 238 are marked on first sides. After transport of the sheets back to entrance path 206, the sheets are re-sequenced and the leading sheet now is sheet 238 and the trailing sheet is 236. Subsequent transport through IOT 202 on the next pass marks sheets 238, 236 on a second side. The sheets 238, 236 can now exit the system 200 along exit path 226. In this manner, media sheets can move in tandem through the printing system 200 in a duplex mode wherein the first sheet processed, i.e. 236, is the last sheet to exit. This transport sequence/configuration can be described as first in/last out (FILO) or last in/first out (LIFO). In the duplex mode, the transport system 204 includes the capability of inverting and staging sheets by using a section of the transport system 204, i.e. the entrance path 206, which is also used to transport media sheets in an uninverted mode.

Figure 8:
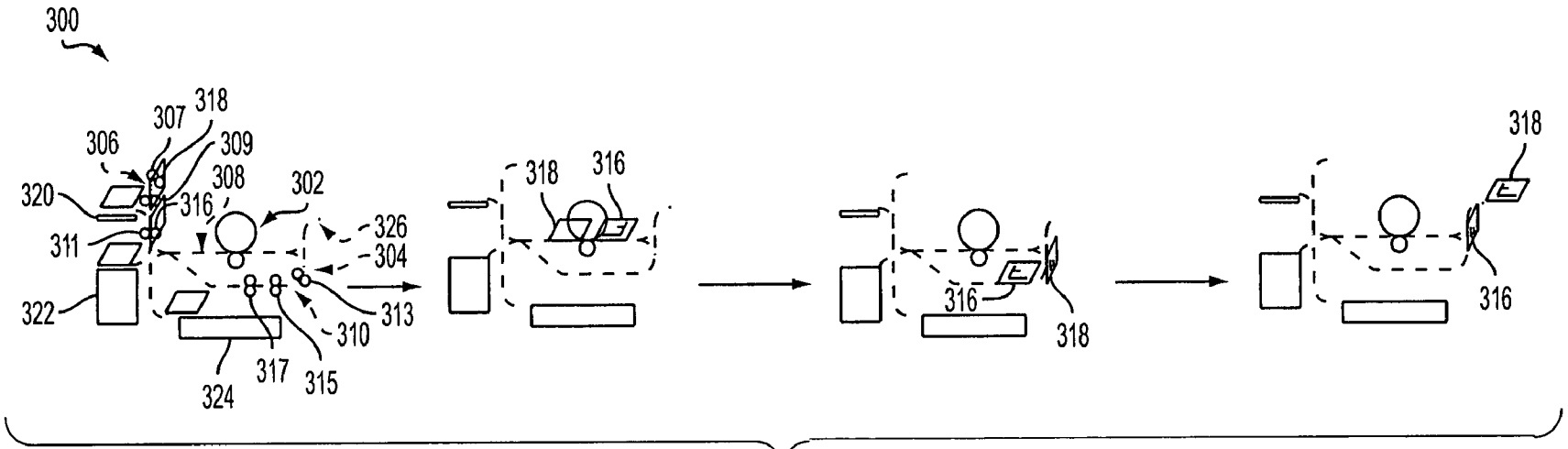
FIG. 8 is a series of sequential schematic views illustrating a simplex flow of media sheets through the printing system according to the third embodiment.
Figure 9:
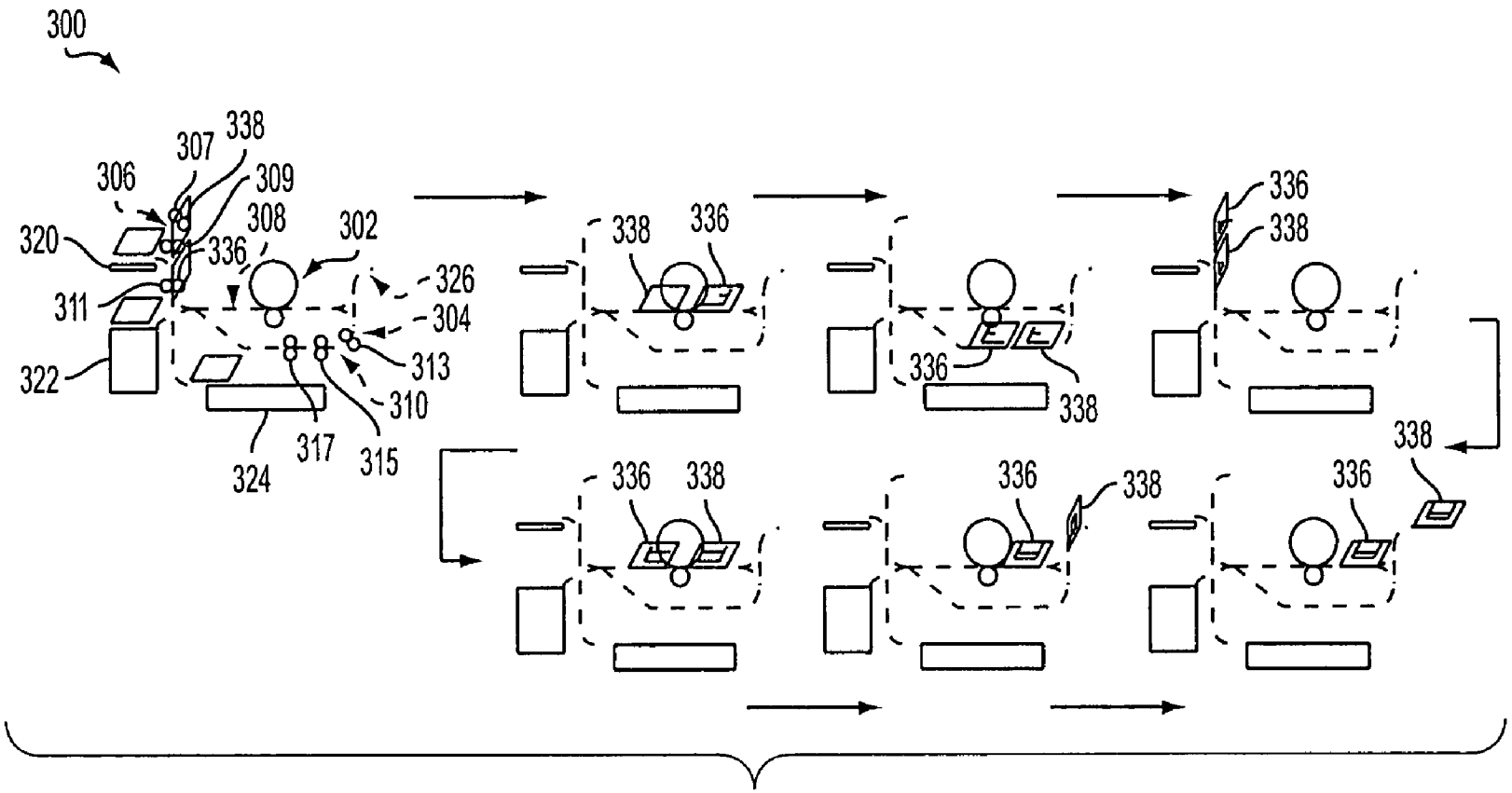
FIG. 9 is a series of sequential schematic views illustrating a duplex flow of media sheets through the printing system according to the third embodiment; and, FIG. 10 shows a schematic view of a printing system illustrating selective architectural components according to a fourth embodiment of the subject developments.

Referring now to FIGS. 7-9, a schematic view is therein shown of a printing system or xerographic device 300 comprising a marking engine according to a third embodiment. More particularly, printing system 300 is illustrated as including primary elements comprising a marking engine or IOT 302 and a reversing roll or inverter media transport system 304. The transport system 304 further includes an entrance path 306, a marking path 308, and a duplex path 310 for moving media sheets or documents through the printing system 300. The entrance path 306 can include more than one reversing drive nip system. As shown in FIG. 8, the entrance path 306 includes three reversing drive nip systems 307, 309, 311.

Referring now to FIG. 8, the printing system 300 can move selective media sheets 316, 318 from feeder sources 322, 324 up into the entrance path 306 and inverted before moving through the IOT 302 on marking path 308. It is to be appreciated that the IOT 302 is a face down marking process. The sheets 316, 318 can be inverted before being delivered to an 'up-hill' exit path 326 by driving the pairs of sheets into the duplex path 310 and then reversing their direction. The driving and reversing in the duplex path 310 can be accomplished with multiple reversing drive nip systems 313, 315, 317. In this manner, media sheets can move in tandem through the printing system 300 in a simplex mode wherein the first sheet processed, i.e. 316, is the last sheet to exit. This transport sequence/configuration can be described relative to the duplex path 310 as first in/last out (FILO) or last in/first out (LIFO).

Referring now to FIG. 9, selective other media sheets 336, 338 can move from feeder sources 322, 324 up into the entrance path 306 driven by a reverse rotation of drive nip systems 307, 309, 311. The drive nip systems can then be changed to a forward rotation thereby moving the media sheets 336, 338 inverted through the IOT 302 along marking path 308, around the duplex path 310, and back up into the entrance path 306. The return of sheets 336, 338 to the entrance path 306 can be accomplished by once again reversing rotation of drive nip systems 307, 309, 311. Once sheets 336, 338 have been moved back to entrance path 306, the media sheets can be staged. The drive nip systems 307, 309, 311 can once again be driven in a forward direction to move the sheets in a re-sequenced order. It is to be appreciated that the media sheets will now be inverted and re-sequenced as the sheets pass through the IOT 302 the second time. Specifically, during the first pass sheet 336 is the leading or first sheet and sheet 338 is the trailing or second sheet. On the first pass of IOT 302, sheets 336, 338 are marked on first sides. After transport of the sheets back to entrance path 306, the sheets are re-sequenced and the leading sheet now is sheet 338 and the trailing sheet is 336. Subsequent transport through IOT 302 on the next pass marks sheets 338, 336 on a second side. The sheets 338, 336 can now exit the system 300 along exit path 326. In this manner, media sheets can move in tandem through the printing system 300 in a duplex mode wherein the first sheet processed, i.e. 336, is the last sheet to exit. This transport sequence/configuration can be described as first in/last out (FILO) or last in/first out (LIFO). In the duplex mode, the transport system 304 includes the capability of inverting and staging sheets by using the entrance path 306 of the transport system 304.

Figure 10:
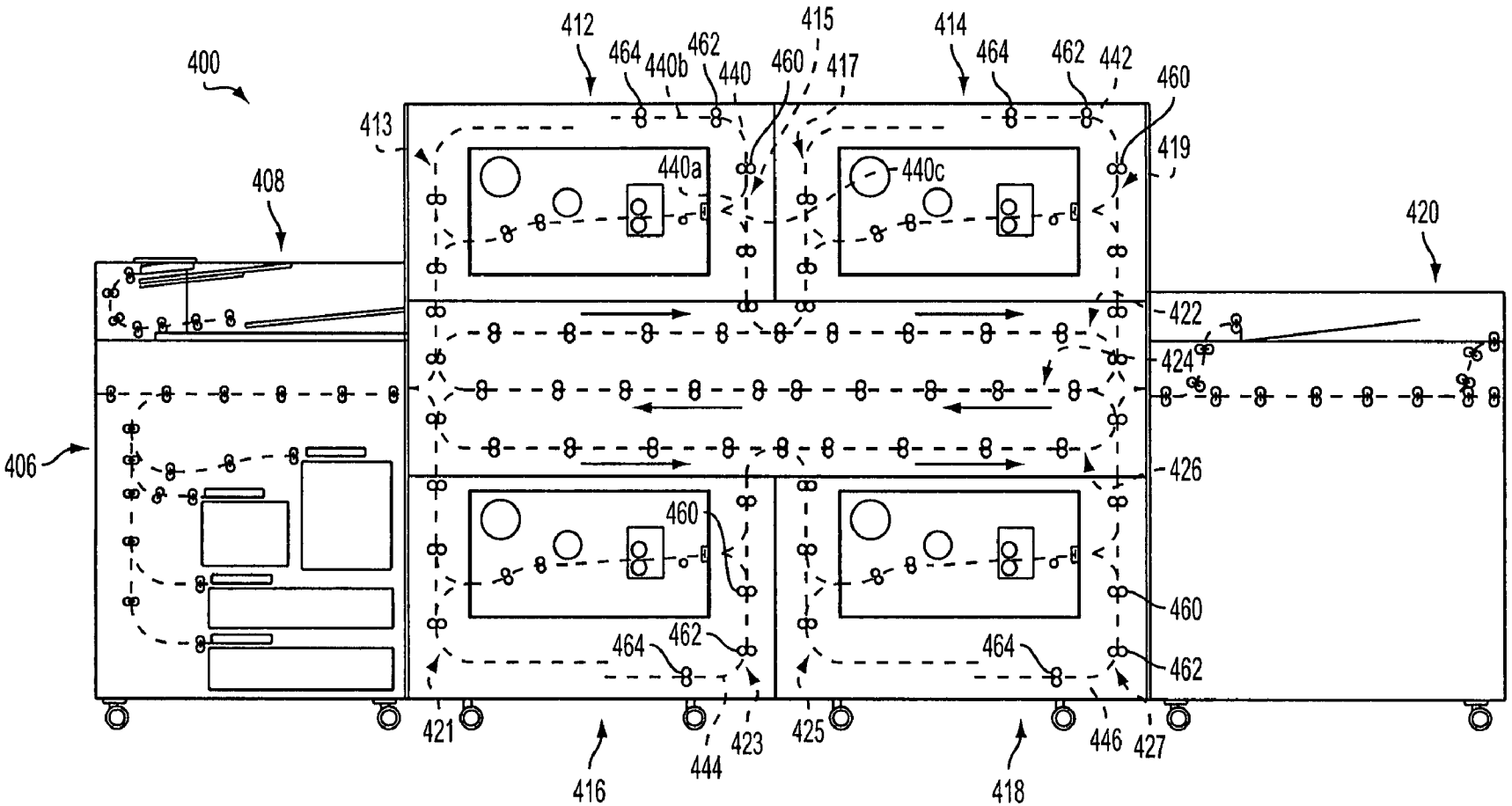

FIG. 10 shows a schematic view of a printing system 400 comprising a plurality of marking engines or xerographic devices associated for tightly integrated parallel printing of documents within the system. More particularly, printing system 400 is illustrated as including primary elements comprising a feeder assembly 406, an image scanning assembly 408, marking engines 412, 414, 416, 418, and a finisher assembly 420. The feeder assembly, marking engines, and finisher assembly are connected by three transport assemblies 422, 424 and 426. The document outputs of a first marking engine 412 can be directed along an exit path 415 either up into an inverter 440 and/or down onto transport 422. The outputs can then be transported to another marking engine 414 and/or to the finisher 420. An example of documents that are to be duplexed printed can be described as follows. After marking on one of the sides of the documents, the documents can exit marking engine 412 onto an exit path 415. The exit path 415 can transport the documents to transport assembly 422. From transport assembly 422, the documents can be moved to an entrance path 417 and then into marking engine 414 for marking on the other sides of the documents. In this manner, the resultant documents are single pass duplex printed. It is to be appreciated that each marking engine 412, 414, 416, 418 can include an entrance path 413, 417, 421, 425 and an exit path 415, 419, 423, 427, respectively. When the marking engines are run in a simplex mode, sheets that exit the marking engines image-side up must be inverted before compiling in the finisher 420. A control station (not shown) allows an operator to selectively control the details of a desired print job.

With reference again to FIG. 10, it can be seen that exit paths 415, 419, 423, 425 include reversing inverter assemblies 440, 442, 444, 446. Each of the reversing inverter assemblies can include a first reversing drive nip system 460, a second reversing drive nip system 462, and a third reversing drive nip system 464. It is to be appreciated that each inverter assembly can include an input path, a staging path and an output path. For example, inverter 440 is shown with input path 440*a*, staging path 440*b*, and output path 440*c*. As described above, pairs of media sheets can move in tandem through a marking engine, i.e. 412, and onto exit path 415. The reversing drive nips 460, 462, 464 can be driven in a reverse direction, thereby moving media sheets up into the inverter 440. Once the sheets have been moved onto the inverter, the media sheets can be staged. The drive nip systems 460, 462, 464 can then be driven in a forward direction to move the sheets in a re-sequenced order out of the exit path 415. It is to be appreciated that the media sheets will now be inverted and re-sequenced as the sheets pass through onto transport assembly 422. On the first pass of marking engine 412, the pairs of media sheets can be marked on first sides. After transport of the sheets onto transport assembly 422 and subsequent movement onto entrance path 417, the pairs of media sheets can be marked on second sides by, for example, marking engine 414. The media sheets, upon transport to exit path 419 can take alternative routes; namely, movement up into inverter assembly 442, exit to finisher 420, or transport back to another marking engine along assembly 424.

As discussed above, the inverter assemblies 440, 442, 444, 446 can be used as sheet buffers and sheet stagers/sequencers, i.e. temporary sheet storage. The staging and re-sequencing of selected media can be manipulated while selected other media can be marked and inverted in one or more of the marking engines and associated inverters. The disposition of such a plurality of inverter assemblies within the overall printing system provides options for implementing desired velocity buffering, staging, and re-sequencing of documents (either singularly or in combination) being transported through the system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A sheet printing apparatus comprising:

a marking engine;

an inverter including an entrance path having a first reversing inverter drive nip system and a second reversing drive nip system;

the printing apparatus further includes a marking path and a duplex path whereby a plurality of media sheets move in tandem continuously through said entrance path, said marking path and said duplex path in a non-overlapping first order sequence, and then said plurality of media sheets move in tandem continuously back to said entrance path in same said non-overlapping first order sequence wherein said plurality of media sheets are inverted and moved again in tandem continuously through said marking path in a non-overlapping second order sequence.

2. The apparatus of claim 1, wherein each said first and said second drive nip system comprises two or more independently driven rollers.

3. The apparatus of claim 1, wherein said plurality of media sheets includes at least a pair of media sheets that move in tandem with a constant gap spacing between said pair of media sheets.

4. The apparatus of claim 1, wherein said plurality of media sheets are fed in tandems such that a gap between sheets in one tandem is smaller than a gap between said one tandem and another tandem.

5. The apparatus of claim 1, wherein said plurality of media sheets are each printed on a first side in said first order sequence and each printed on a second side in said second order sequence.

6. The apparatus of claim 1, wherein said first reversing inverter drive nip system spaced from said second reversing drive nip system along said entrance path for moving said plurality of media sheets in a forward and a reverse direction.

7. The apparatus of claim 1, wherein said entrance path stages said plurality of media sheets prior to movement through said marking path.

8. The apparatus of claim 1, wherein said first order sequence includes at least a first sheet followed by at least a second sheet and said second order sequence includes said at least second sheet followed by said at least first sheet.

9. The apparatus of claim 1, wherein said inverter is an input inverter and wherein the input inverter can receive said plurality of media sheets from said duplex path and an upstream transport path and transport said plurality of media sheets to said marking path.

10. A printing system comprising:

an inverter assembly associated with a marking engine; and, said inverter assembly consisting of a first reversing inverter drive nip system, a second reversing inverter drive nip system spaced from said first reversing inverter drive nip system, and at least a third reversing drive nip system spaced from said second reversing drive nip system wherein a plurality of media sheets enter in tandem said inverter assembly in a first order sequence and exit in tandem said inverter assembly inverted in a second order sequence wherein a constant gap is maintained between said plurality of media sheets from said first order sequence to said second order sequence; said first order sequence includes a first sheet, followed by a second sheet, which in turn is followed by at least a third sheet; and, wherein said second order sequence includes said at least third sheet followed by said second sheet which in turn is followed by said first sheet.

11. An inverter apparatus comprising:

an inverter consisting of selectively reversing inverter rollers, an input path, a staging path, and an output path for selectively inverting at least two documents for tandem transport; and, said at least two documents move in tandem concurrently in a first direction through same said input path into same said staging path in a first order and then move in a second direction simultaneously from same said staging path through same said output path in a second order.

12. The inverter apparatus of claim 11, wherein said selectively reversing inverter rollers include at least a first reversing inverter drive nip system and a second reversing inverter drive nip system spaced therefrom.

13. The inverter apparatus of claim 11, wherein said first order sequence includes at least a first sheet followed by at least a second sheet and said second order sequence includes said at least second sheet followed by said first sheet.

14. A method comprising:

transporting at least two media sheets in tandem to an inverter assembly;

transporting said at least two media sheets in tandem from said inverter assembly in a first egress order through a marking engine for marking on each of a first side;

returning said at least two media sheets in tandem along a duplex path to said inverter assembly; and, transporting said at least two media sheets in tandem from said inverter assembly in a second egress order through said marking engine for marking on each of a second side, wherein said first egress order includes at least a first sheet followed by at least a second sheet and said second egress order includes said at least second sheet followed by said at least first sheet.

15. A method comprising:

transporting concurrently at least two media sheets continuously in tandem having a gap between said two media sheets to an inverter assembly through an input path in a first order wherein said inverter assembly includes a first reversing drive nip system and a second reversing drive nip system; and, transporting concurrently same said at least two media sheets continuously in tandem with same said gap from said inverter assembly through an output path in a second order.

16. The method of claim 15, wherein a last of said at least two media sheets into said inverter assembly becomes a first of said at least two media sheets out of said inverter assembly.

17. The method of claim 15, wherein said first order includes a first sheet followed by a second sheet and said second order includes said second sheet followed by said first sheet.

* * * * *